US010449100B2

(12) United States Patent
Hector

(10) Patent No.: US 10,449,100 B2
(45) Date of Patent: Oct. 22, 2019

(54) LIFT ASSIST CHAIR

(71) Applicant: Norbert Hector, Browns Summit, NC (US)

(72) Inventor: Norbert Hector, Browns Summit, NC (US)

(73) Assignee: Francis Norbert Hector, Jr. and Karolyn M. Hector, Browns Summit, NC (US), as Co-Trustees of the Francis N. Hector, Sr. and Bertha F. Hector Irrevocable Trust ( * ) Notice: Subject to any disclaimer, the term of this patent is extended or adjusted under 35 U.S.C. 154(b) by 83 days.

(21) Appl. No.: 15/794,737

(22) Filed: Oct. 26, 2017

(65) Prior Publication Data

US 2019/0125601 A1 May 2, 2019

(51) Int. Cl.

| | |
|---|---|
| ***A61G 5/14*** | (2006.01) |
| ***A61G 5/12*** | (2006.01) |
| ***A61G 5/10*** | (2006.01) |

(52) U.S. Cl.

CPC ..... *A61G 5/14* (2013.01); *A61G 5/1056* (2013.01); *A61G 5/125* (2016.11)

(58) Field of Classification Search

USPC ..... 297/DIG. 10

See application file for complete search history.

(56) References Cited

U.S. PATENT DOCUMENTS

| | | | | | |
|---|---|---|---|---|---|
| 3,259,427 | A | | 7/1966 | Wiest | |
| 4,569,556 | A | * | 2/1986 | Pillot | A61G 5/14 297/316 |
| 4,632,455 | A | * | 12/1986 | Schiller | A61G 5/14 297/183.9 |
| 4,929,022 | A | | 5/1990 | Geraci | |
| 5,116,100 | A | | 5/1992 | Iversen | |
| 5,178,025 | A | * | 1/1993 | Bennett | A61G 5/14 248/561 |
| 5,312,157 | A | * | 5/1994 | Logan, Jr. | A61G 5/14 297/250.1 |
| 5,498,064 | A | | 3/1996 | Hooker et al. | |
| 6,192,533 | B1 | * | 2/2001 | Porcheron | A61G 5/14 280/304.1 |
| 6,440,046 | B1 | * | 8/2002 | Tholkes | A61G 5/14 280/250.1 |
| 7,434,882 | B1 | | 10/2008 | Hodges | |

(Continued)

FOREIGN PATENT DOCUMENTS

| | | | | |
|---|---|---|---|---|
| DE | 19748852 | A1 * | 5/1999 | A61G 5/1018 |
| GB | 190325800 | A * | 10/1904 | |
| JP | 2016202677 | A | 12/2016 | |

*Primary Examiner* — David E Allred

(74) *Attorney, Agent, or Firm* — Coats & Bennett, PLLC

(57) ABSTRACT

A seat on a lift assist chair pivots between a lowered position in which a user can sit in the chair, and a raised position in which a seated user is helped out of the chair and into a standing position. A pair of arms is operatively attached to the seat. Responsive to the application of a user-applied downward force, the arms pivot about an axis thereby causing the seat to pivot between the lowered position and the raised position. First and second counterweights are also connected to the arms, and are axially adjustable relative to the axis about which the arms pivot. This movement permits the user to selectively alter the moment of the pivotable arms.

11 Claims, 10 Drawing Sheets

(56) References Cited

U.S. PATENT DOCUMENTS

| | | | | |
|---|---|---|---|---|
| 8,360,518 | B2 * | 1/2013 | Braaten | A61G 5/1054 297/183.6 |
| 2005/0104430 | A1 * | 5/2005 | Splane, Jr. | A61G 5/14 297/313 |
| 2007/0151007 | A1 * | 7/2007 | Wilkinson | A47K 13/10 4/246.1 |
| 2010/0141003 | A1 * | 6/2010 | Combs | A61G 5/14 297/313 |
| 2013/0175840 | A1 | 7/2013 | Nadav | |
| 2013/0264800 | A1 * | 10/2013 | Kobayashi | A61G 5/006 280/650 |
| 2016/0067125 | A1 | 3/2016 | Splane, Jr. et al. | |
| 2016/0374879 | A1 * | 12/2016 | Christian | A61G 5/14 297/313 |
| 2018/0177653 | A1 * | 6/2018 | Bergman | A61G 5/1059 |

* cited by examiner

LIFT ASSIST CHAIR

FIELD OF DISCLOSURE

The present disclosure relates generally to chairs, and more particularly, to lift assist chairs for helping individual users into and out of a sitting position.

BACKGROUND

People generally spend a considerable amount of time sitting in a chair. Traditionally, chairs place the legs of the user in a substantially right-angled position, where the thigh is positioned substantially perpendicularly with the rest of the leg. Therefore, elevating oneself from a seated position into an upright or standing position typically requires the user to have a sufficient amount of knee flexibility, balance, and muscular strength in order to safely get in and out of the chair.

For most people, getting into and out of a chair is not a problem. For others, however, it is. For example, some people suffer from a variety of disorders and diseases that make transitioning from a seated position to a standing position (and vice versa) extremely difficult, and in some cases, impossible. Users having arthritic knee joints, for example, could have reduced mobility and flexion of the knees. Additionally, people with certain neurological disorders or diseases, such as Parkinson's disease, have great difficulty in maintaining their balance. Regardless of the particular malady, however, such difficulty in getting into and out of a chair can increase stress on the user's muscles and joints, increase fatigue, and increase risk of physical injury.

SUMMARY

Embodiments of the present disclosure provide a lift assist chair and corresponding method for assisting a user into and out of the chair. Particularly, in one embodiment, a lift assist chair configured according to the present disclosure comprises a frame, a seat, first and second arms, and first and second adjustable counterweights.

The seat is pivotably connected to the frame and configured to pivot between a lowered position to support a user seated in the chair, and a raised position to assist the user into a standing position. The first and second arms are operatively connected to the seat, and configured to pivot the seat to the raised position responsive to a force applied to the first and second arms by the user. The first and second adjustable counterweights are connected, respectively, to the first and second arms. Each of the first and second counterweights is axially adjustable relative to the first and second arms to change an amount of the force necessary to pivot the seat to the raised position.

Additionally, the present disclosure also provides a method of assisting a user seated in a lift assist chair into a standing position. The method comprises adjusting a moment of first and second arms of the lift assist chair by axially adjusting first and second counterweights relative to a moment axis. The first and second counterweights are connected to the first and second arms and are configured to pivot about the moment axis. The method also comprises applying a force to a front portion of the first and second arms to pivot the first and second arms about the moment axis, and pivoting a seat of the lift assist chair from a lowered position to a raised position to assist the user out of the lift assist chair and into a standing position responsive to the force being applied to the first and second arms.

BRIEF DESCRIPTION OF THE DRAWINGS

Aspects of the present disclosure are illustrated by way of example and are not limited by the accompanying figures with like references indicating like elements.

DETAILED DESCRIPTION

Embodiments of the present disclosure provide a lift assist chair and corresponding method for assisting a user into and out of the chair. More particularly, a lift assist chair configured according to the present embodiments comprises a seat that pivots between a lowered position in which the user can sit in the chair, and a raised position in which a user who is seated in the chair is helped into a standing position. The chair also comprises first and second pivotable arms operatively connected to a rear portion of the seat. To pivot the seat between the lowered position and the raised position, the user presses downward on a front portion of the first and second arms. This downward force pivots the rear of the seat upwardly through an angle $\alpha$, thereby assisting a seated user into a standing position. Additionally, the chair comprises first and second adjustable counterweights that are connected, respectively, to the first and second arms. Each of the first and second counterweights is axially adjustable relative to an axis about which the first and second arms pivot to increase and decrease the amount of force that the user must apply to pivot the seat to the raised position. With the seat in the raised position, the user can easily move to a full standing position upon exiting the raised seat.

Figure 1A:
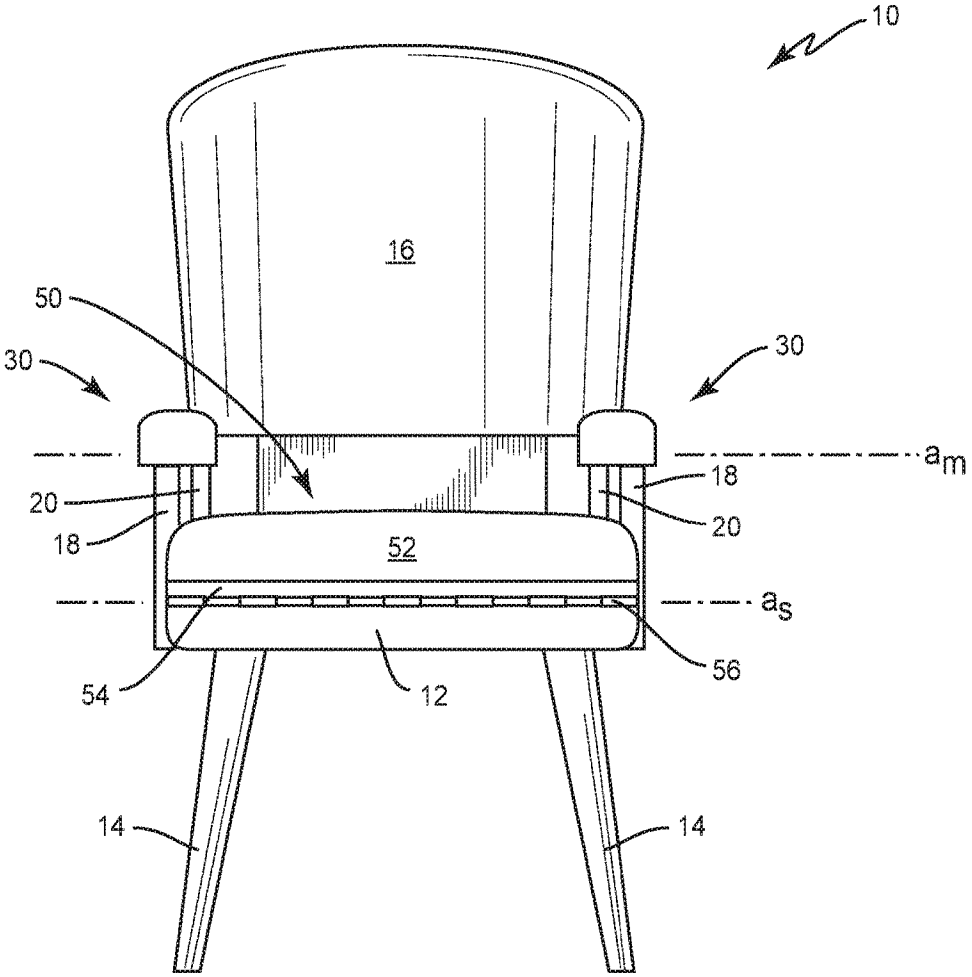
FIGS. 1A-1C illustrate a lift assist chair configured according to one embodiment of the present disclosure.
Figure 1C:
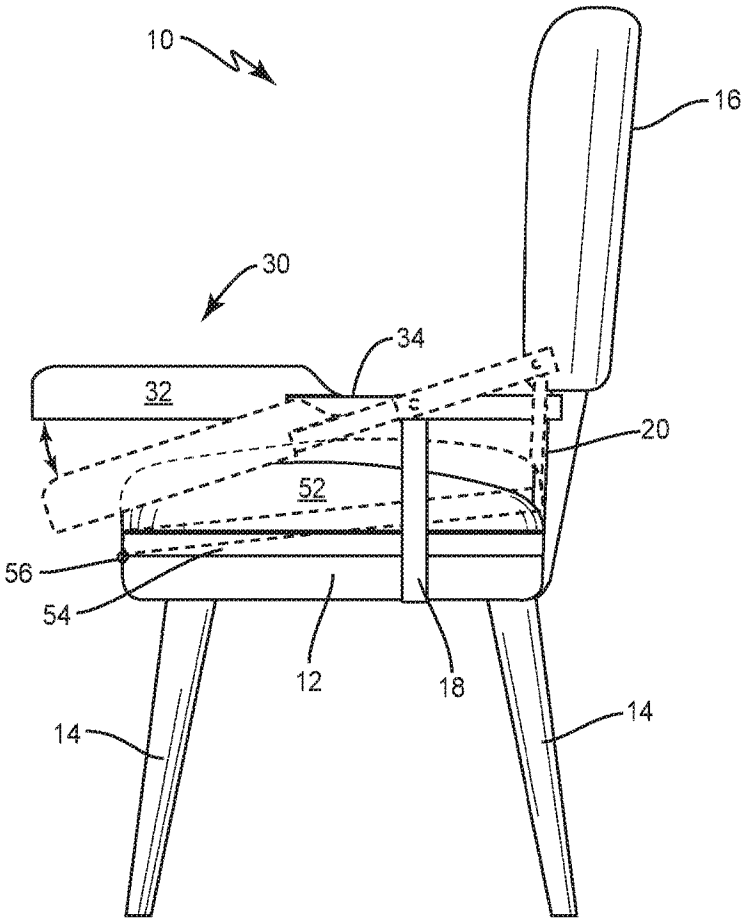
Figure 1B:
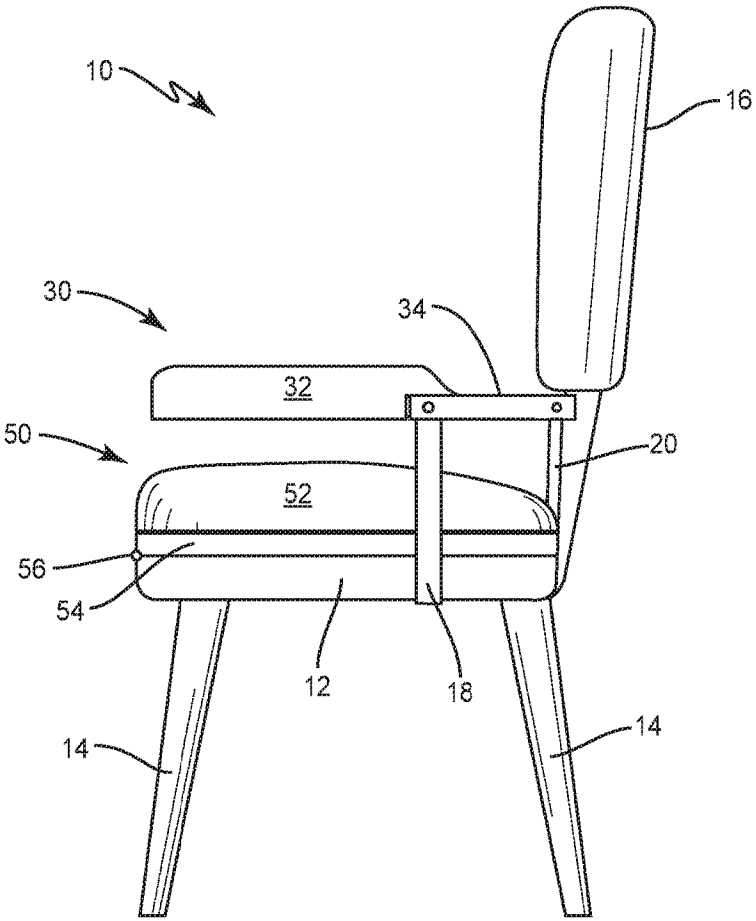

Turning now to the drawings, FIGS. 1A-1C show a lift assist chair 10 configured according to one embodiment of the present disclosure. It should be noted that the figures illustrate lift assist chair 10 as being a chair in which a user may be seated while at a dinner table or a desk. However, this is merely for illustrative purposes. Those of ordinary skill in the art will understand that chair 10 configured according to the present embodiments may be any type of apparatus on which a user may be seated, and in which the user requires assistance to transition between a sitting position and a standing position. Some non-limiting examples of such seating devices include couches, sofas, stools, and loveseats.

As seen in the embodiment of FIGS. 1A-1C, a lift assist chair 10 configured according to the present embodiments comprises a frame 12, a plurality of legs 14, a backrest 16, first and second stanchions 18, first and second connectors 20, first and second arm assemblies 30, and a seat assembly 50. Frame 12 provides a stable base for the components of the lift assist chair 10, and is able to sufficiently support a user's weight when the user is seated. As seen in the figures, frame 12 is constructed from wood. However, those of ordinary skill in the art will appreciate that the present embodiments of the frame 12 are not so limited. In other embodiments, for example, frame 12 is constructed from metal or plastic.

Legs 14 are attached to the frame 12 using mechanical fasteners (e.g., screws, bolts) and/or glue, and elevate the frame 12 above a ground surface. The length of the legs 14 may vary based on the specific application of the chair 10. Thus, legs 14 that are attached to a couch or loveseat, for example, will be shorter in length than those attached to a chair used at a dinner table. Regardless of length, however, casters may be attached to the bottom of the legs 14 to facilitate movement of the chair 10 across the ground surface.

The backrest 16 of chair 10 is an optional component. However, when present, backrest 16 is attached to frame 12 using mechanical fasteners (e.g., screws, bolts) and/or glue, and provides a stable, generally upright surface that supports the back of a seated user.

As seen in the figures, the first and second stanchions 18, the first and second connectors 20, and the first and second arm assemblies 30 are connected on opposing right and left sides of the lift assist chair 10, respectively. More particularly, one end of each of the first and second stanchions 18 is attached to a respective left or right side portion of frame 12, while the other end of each of the first and second stanchions 18 is attached to a corresponding one of the first and second arm assemblies 30. Similarly, one end of each of the first and second connectors 20 is attached to opposing left or right sides of the seat assembly 50, respectively, while the other end is attached to rear portion of a respective one of the arm assemblies 30.

In this configuration, the first and second stanchions 18 function as fulcrums. Particularly, when a user who is seated in chair 10 requires assistance to get out of chair 10, he/she exerts a downward force on a front portion of each of the arm assemblies 30. This causes the front portion of the arm assemblies 30 to pivot downwardly about a moment axis $a_m$, which in turn, raises a rear part of the seat assembly 50 upwardly via the first and second connectors 20. As seen in more detail later, this movement allows the seat assembly 50 to pivot between a lowered position in which a user may sit in the chair 10 (e.g., FIG. 1B), and a raised position (e.g., FIG. 1C) in which the user is assisted out of the seated position and into a standing position.

According to the present embodiments, each of the first and second arm assemblies 30 comprises an adjustable counterweight 32 connected to arm 34. In this embodiment, each adjustable counterweight 32 is movable by the user axially relative to the moment axis $a_m$, and thus, is configured to move towards and away from the arm 34 responsive to user action. As previously described, pivoting the front of each arm assembly 30 downward about its moment axis $a_m$ lifts a rear portion of seat assembly 50 through an angle $\alpha$ from the lowered position into a raised position thereby assisting a user who is sitting in the chair 10 out of the chair 10 and into a standing position.

Having the adjustable counterweights 32 permits the lift assist chair 10 of the present embodiments to provide functionality that conventional lift assist chairs are not able to provide. Particularly, although conventional manually-operated lift assist chairs have pivotable arms, the moment of those arms is fixed and not adjustable. However, because chair 10 allows a user to move the adjustable counterweights 32 axially relative to its moment axis $a_m$, the user is able to selectively alter the moment of the first and second arm assemblies, respectively. As described in more detail later, this functionality makes it easier for a user to pivot the arm assemblies 30 downwardly.

Seat assembly 50 comprises a seat cushion 52, a seat base 54, and a hinge 56. The seat cushion 52 comprises a soft piece of foam or other soft material, for example, on which the user sits. The seat base 54 comprises a ridged piece of plastic or wood, for example, and forms a platform on which a seat cushion 52 is attached. The hinge 56 pivotably attaches a front of the seat base 54 to a front of the frame 12. Thus, when the user pushes down on the adjustable counterweights 32, the seat base 54 pivots on hinge 56 about a seat axis $a_s$, thereby raising the rear of the seat assembly 50 to assist the user sitting on the seat cushion 52 out of the chair 10 and into the standing position.

Figure 2A:
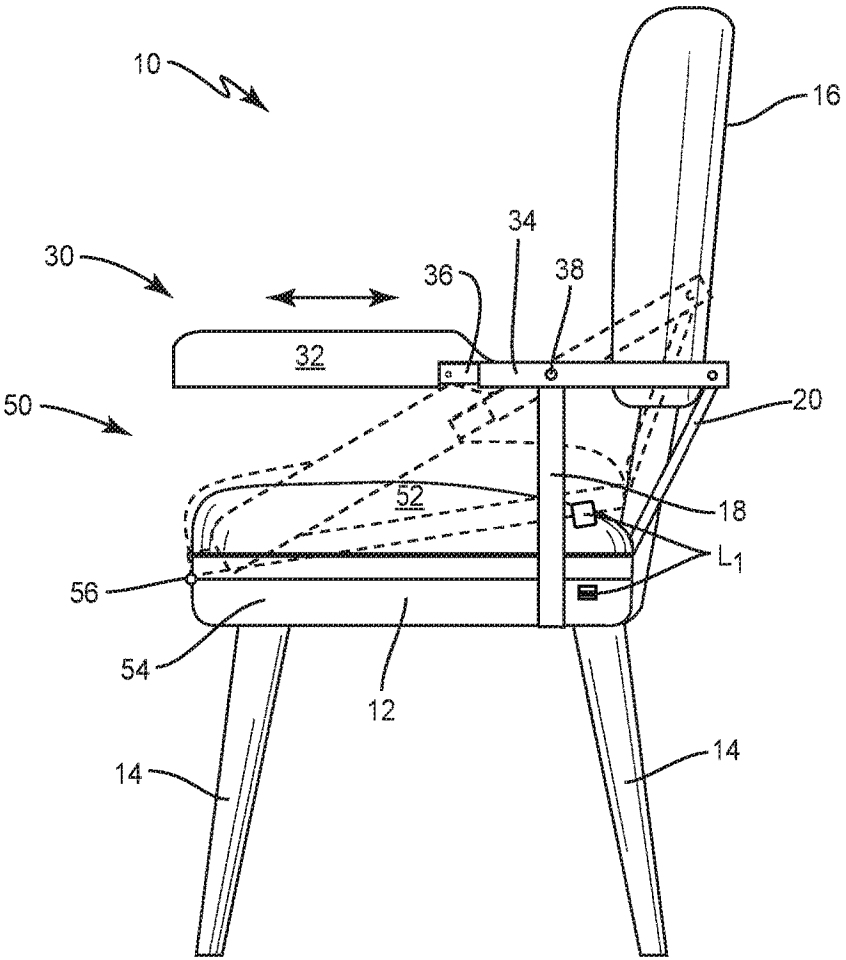
FIGS. 2A-2B illustrate an axially adjustable counterweight and a pivotable arm assembly according to one embodiment of the present disclosure.
Figure 2B:
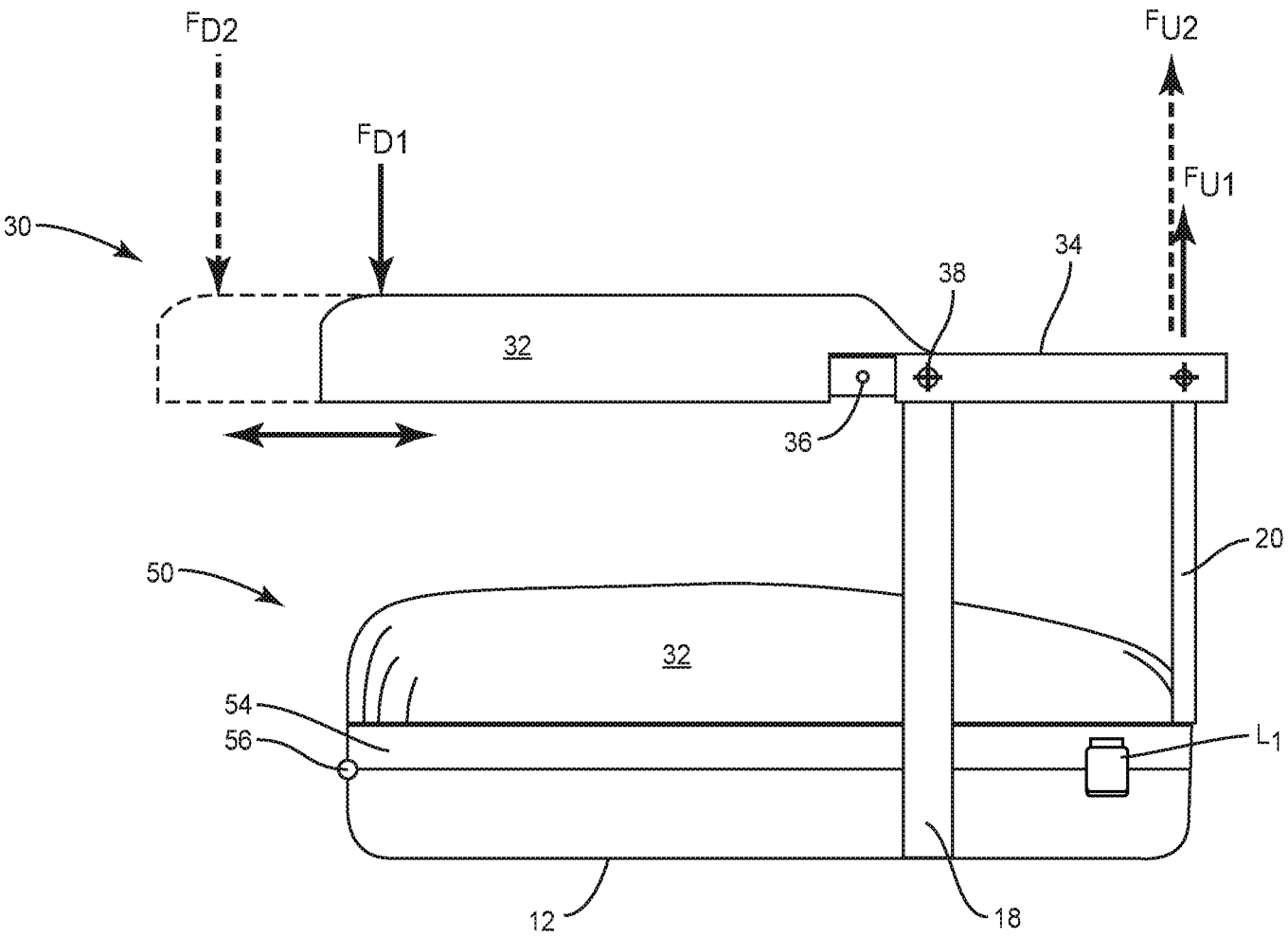

FIGS. 2A and 2B illustrate the movement of the arm assemblies 30 in more detail. As seen in these figures, each of the first and second adjustable counterweights 32 comprises a mass having a predetermined weight, and is configured to move axially towards and away from the arm 34. According to the present disclosure, the masses that comprise the adjustable counterweights 32 are replaceable by the user. This permits the user to remove one set of adjustable counterweights 32 that may be too heavy or too light, and replace them with another set of adjustable counterweights 32 having a more suitable weight. In one embodiment, for example, a spring loaded detent 36 is disposed on each arm 34. To replace a given counterweight 32, the user simply depresses the detent 36 and pulls the adjustable counterweight 32 away from arm 34. The user may then slide a replacement adjustable counterweight 32 over the arm 34. When the detent 36 extends through a corresponding hole in the replacement adjustable counterweight 32, the counterweight 32 is coupled to the arm 34.

Additionally, as previously stated, the counterweight 32 is axially adjustable relative to the arm 34. As seen in FIGS. 2A to 2B, the user may slide the counterweight 32 away from the arm 34, or slide the counterweight 32 closer towards the arm 34. This adjustment functions as a fine adjustment for the user. Particularly, once a user has attached an adjustable counterweight 32 having an appropriate mass to the arm 34, the user may move the counterweight 32 towards or away from the arm 34. This axial movement adjusts the moment of the arm assembly 30 and provides assistance to a user seeking to rise into a standing position from a sitting position.

FIG. 2A illustrates this concept in more detail. As seen in FIG. 2A a user pushing down on counterweight 32 causes the arm assembly 30 to pivot at pivot point 38 and axis $a_m$. However, the particular point on the counterweight 32 at which the user pushes downwardly can alter the amount of downward force the user is required to use to pivot the arm assembly 30.

Specifically, as seen in FIG. 2B, a downward force $F_{D1}$ exerted on the counterweight 32 results in a first upward force $F_{U1}$, while a downward force $F_{D2}$ exerted on the counterweight 32 results in a second upward force $F_{U2}$. The amount of downward force $F_{D1}$, $F_{D2}$ required to pivot the arm assembly 30 is governed by the "law of the lever." Particularly, if the distance between the pivot point 38 and the point at which the downward force $F_{D1}$, $F_{D2}$ is applied is greater than the distance between the pivot point 38 and the point at which the upward force $F_{U1}$, $F_{U2}$ is applied, then the lever (i.e., the arm assembly 30) amplifies the downward force. On the other hand, if the distance between the pivot point 38 and the point at which the downward force $F_{D1}$, $F_{D2}$ is applied is less than the distance between the pivot point 38 and the point at which the upward force $F_{U1}$, $F_{U2}$ is applied, then the downward force is not amplified, but rather, reduced by the lever.

As seen in the embodiment of FIG. 2B, the distance between the pivot point 38 and the point at which the upward force $F_{U1}$, $F_{U2}$ is applied does not change. However, according to the present embodiments, the distance between the pivot point 38 and the point at which the upward force $F_{U1}$, $F_{U2}$ is applied is axially adjustable. Therefore, by moving the counterweight 32 axially relative to the pivot point 38, the user can control the amount of "force amplification" provided by the arm assembly 30 and adjust the amount of downward force that must be applied to rise into the standing position. For example, as seen in FIG. 2B, the distance between $F_{D1}$ and the moment axis $a_m$, which is defined by pivot point 38, is less than the distance between $F_{D2}$ and the moment axis $a_m$. Thus, the downward force $F_{D1}$ that the user must exert to pivot the arm assembly 30 downward at pivot point 38 and moment axis $a_m$ is greater than the downward force $F_{D2}$ the user must exert when the counterweight 32 is farther away from the pivot point 38 and moment axis $a_m$. Regardless of the amount of downward force that is applied by the user, as well as the point on counterweight 32 at which the user applies the downward force, however, the arm assembly 30 pivots at pivot point 38 about the moment axis $a_m$.

As previously described, the seat base 54 pivots on hinge 56 through an angle $\alpha$ responsive to the application of a downward force $F_{D1}$, $F_{D2}$ on a front portion of the axially adjustable counterweights 32. In some situations, however, a user may not want the seat base 54 to pivot to the raised position. Accordingly, embodiments of the present disclosure also provide a user-operated latch $L_1$ configured to move between a latched position and an unlatched position. Latch $L_1$ may be any type and/or number of latches needed or desired. Regardless, however, when latched (FIG. 2B), latch $L_1$ maintains seat base 54 is the lowered position and prevents seat base 54 from pivoting to the raised position. When unlatched (FIG. 2A), latch $L_1$ is configured to allow seat base 54 to pivot into the raised position.

It should be noted that FIGS. 2A and 2B illustrate latch $L_1$ positioned on a side of the chair 10. However, those of ordinary skill in the art will appreciate that this is illustrative only. The number and types of latches $L_1$ suitable for use in embodiments of the present disclosure, as well as the placement of such latches $L_1$ on chair 10, are not restricted.

In accordance with embodiments of the present disclosure, that angle $\alpha$ is also dynamically adjustable by the user. The ability to vary the angle $\alpha$ through which the seat base 54 pivots allows the user to control how much lift assistance is provided by chair 10.

Figure 3B:
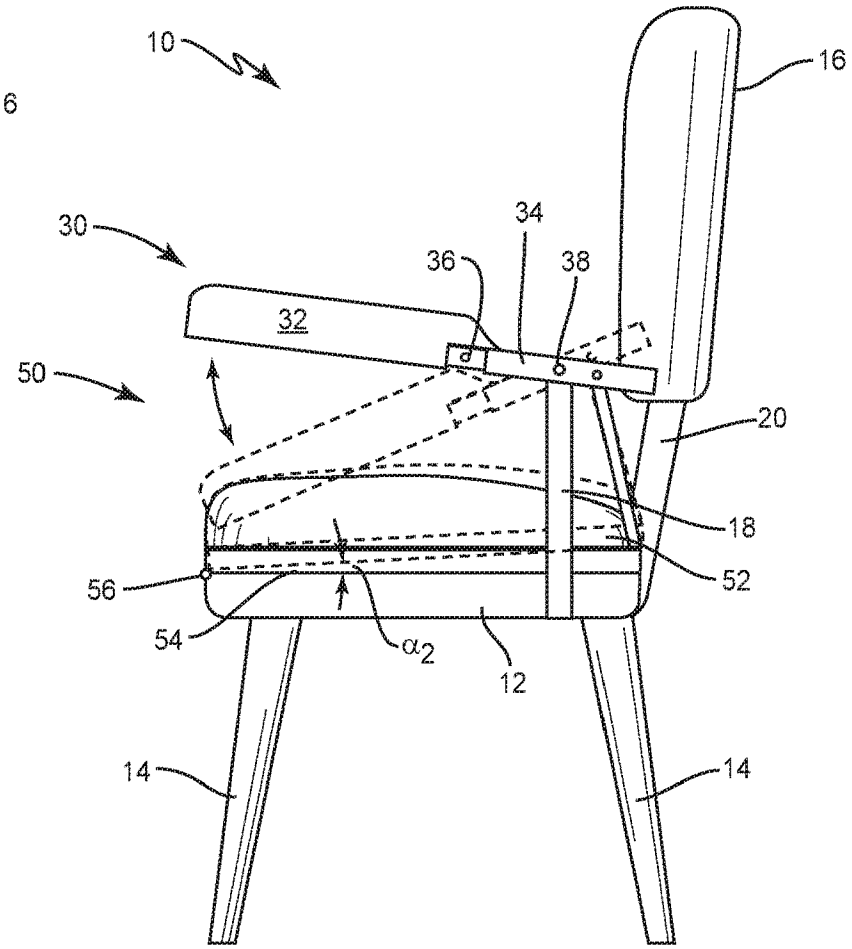
FIGS. 3A-3B illustrate a lift assist chair having an adjustable connector for coupling an arm assembly of the lift assist chair to a seat assembly of the lift assist chair according to embodiment of the present disclosure.
Figure 3A:
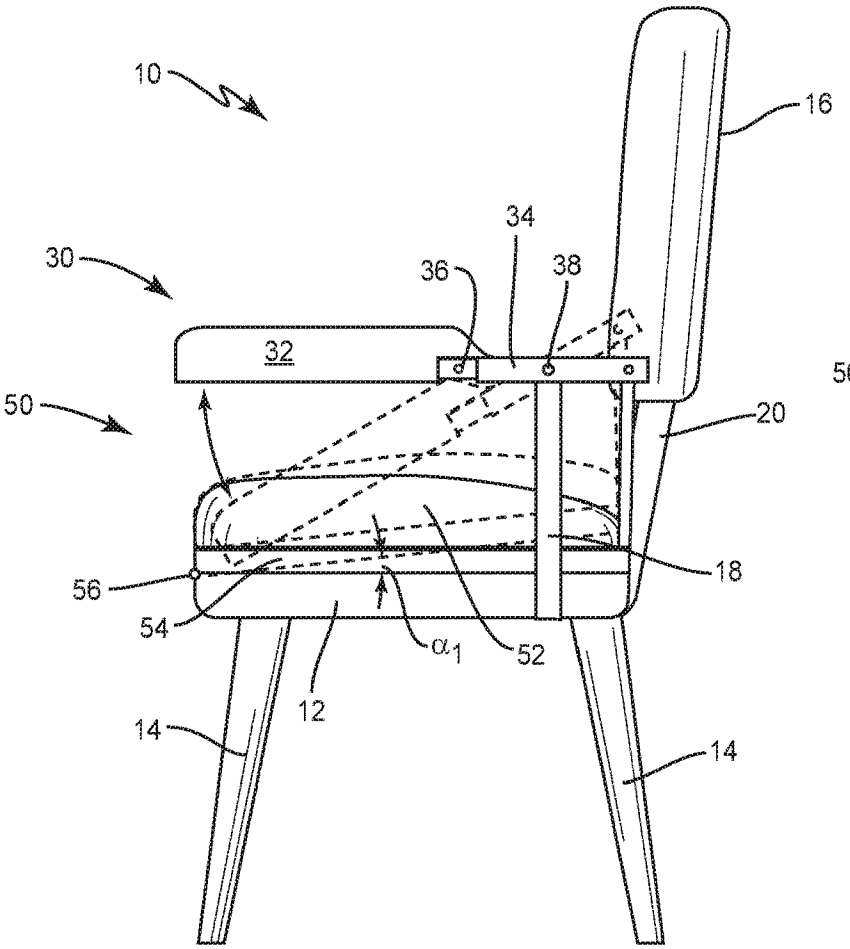

Additionally, in order to adjust angle $\alpha$, the user needs only to move the point at which the connectors 20 connect to the rear portion of the arm 34. For example, as seen in FIG. 3A, connector 20 is connected to arm 34 proximate a terminal end of arm 34. In this position, a user who pushes downward on the adjustable counterweight 32 will pivot the seat base 54, and thus, the seat assembly 50, through a first angle $\alpha_1$. In FIG. 3B, however, the point at which connector 20 is connected to arm 34 lies closer to the pivot point 38 and stanchion 18. In this position, pushing downward on the counterweight 32 pivots the seat base 54 through a second angle $\alpha_2$. As seen in FIGS. 3A through 3B, first angle $\alpha_1$ is greater than second angle $\alpha_2$. Thus, connecting the connector 20 to arm 34 at different positions will vary (i.e., increase or decrease) the angle $\alpha$ with which the seat assembly 50 is raised from the lowered position to the raised position.

As previously described, moving the connector 20 closer to or farther away from the pivot point 38 and moment axis $a_m$, may affect the amount of downward force $F_{D1}$, $F_{D2}$ the user must apply to pivot the arm assembly 30. However, the present embodiments still allow the user to replace the counterweights 32 with other, lighter or heavier counterweights 32, as well as adjust the position of those counterweights 32 axially relative to the pivot point 38 and moment axis $a_m$. Therefore, even though moving the connector 20 closer to the pivot point 38 will require the user to exert a greater amount downward force $F_{D1}$, $F_{D2}$, to pivot the seat assembly 50, the present embodiments allow the user to counteract that effect by replacing the counterweights 32 and/or by axially adjusting the position of the counterweights 32 relative to the pivot point 38 and moment axis $a_m$.

Figure 4B:
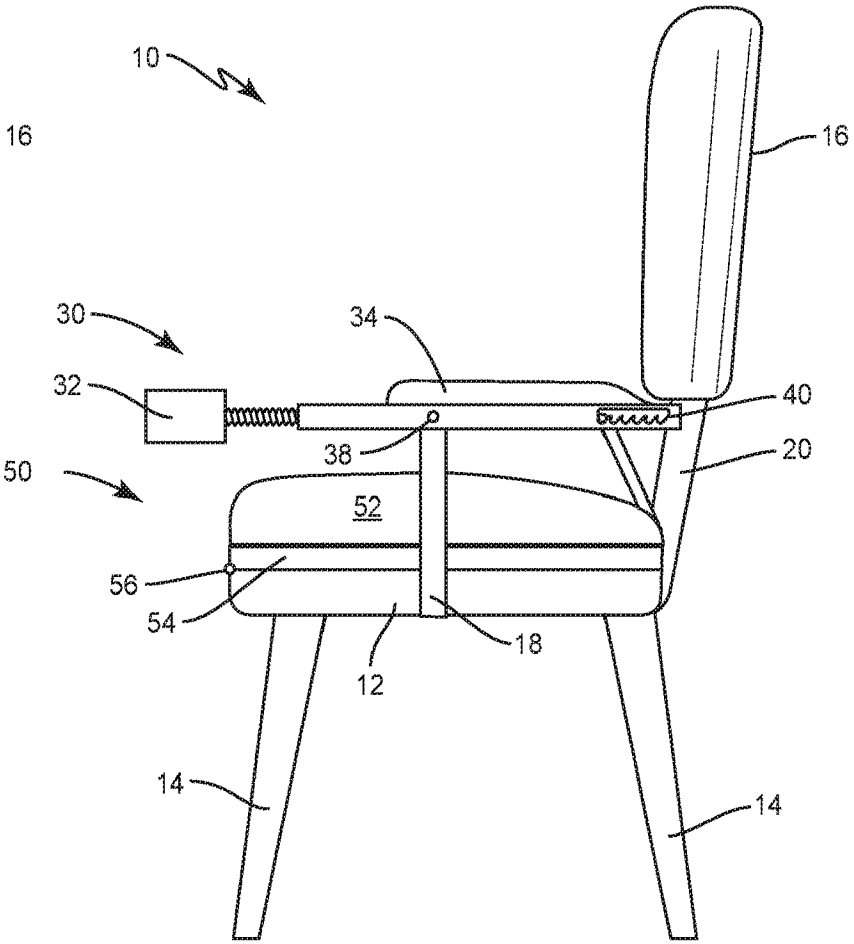
FIGS. 4A-4B illustrate a lift assist chair having an axially adjustable counterweight and an adjustable connector according to another embodiment of the present disclosure.
Figure 4A:
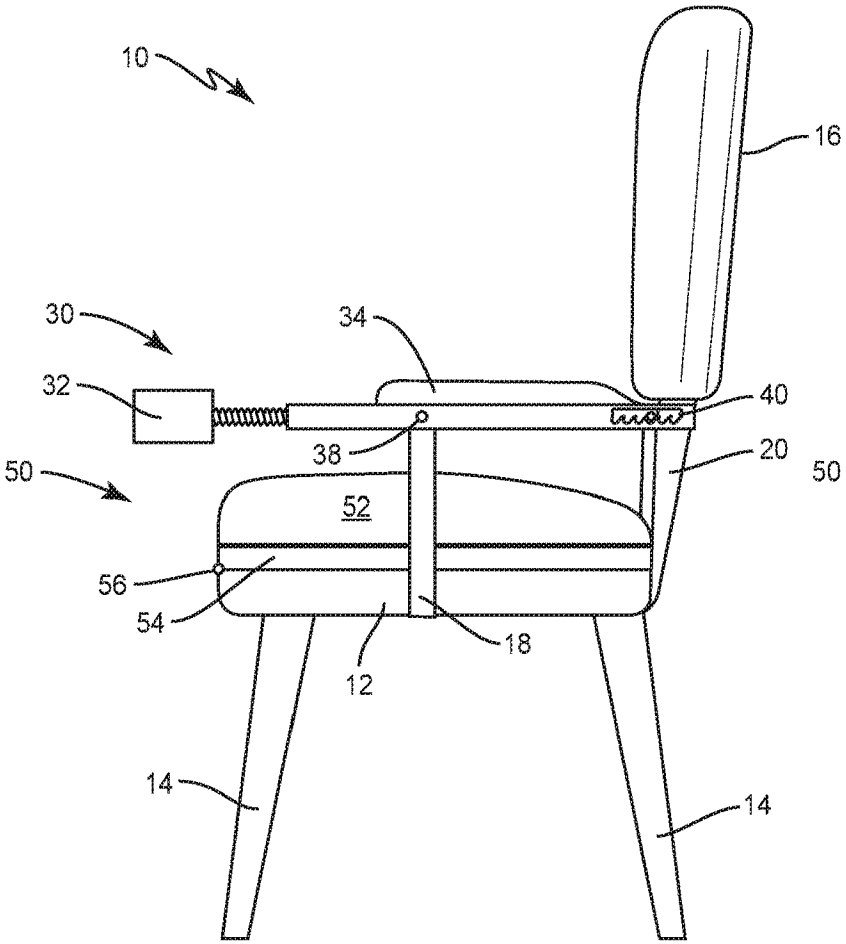

FIGS. 4A and 4B illustrate the lift assist chair 10 configured to another embodiment of the present disclosure. In this embodiment, the adjustable counterweight 32 threadingly attaches to a threaded receptacle disposed in arm 34. To adjust the position of the counterweight 32, the user needs only to rotate the counterweight 32 to the right or left to move the counterweight 32 axially towards and away from the arm 34. Although the method of axially adjusting the counterweight 32 is different than in the previous embodiments, the counterweight 32 still functions as a fine adjustment that allows the user to increase or decrease the moment of the arm assembly 30. Additionally, as in the previous embodiments, counterweight 32 is replaceable with various counterweights 32 having other masses that are heavier or lighter.

FIGS. 4A-4B also illustrate another method of adjustably connecting the connector 20 to the arm assembly 30. Particularly, the arm 34 in this embodiment comprises a variable adjustment slot 40 formed proximate a rear portion of arm 34. The variable adjustment slot 40 further comprises a plurality of angled predetermined notches or slots. The connector 20 in this embodiment is configured to be attached to the arm 34 at various positions along the variable adjustment slot 40 by inserting a pin or other rigid member extending outwardly from the connector 20 into the various notches or slots. This adjustment effectively lengthens or shortens the connector 20, and allows a user to adjust the angle $\alpha$ through which the seat assembly 50 pivots from the lowered position to the raised position.

Figure 5:
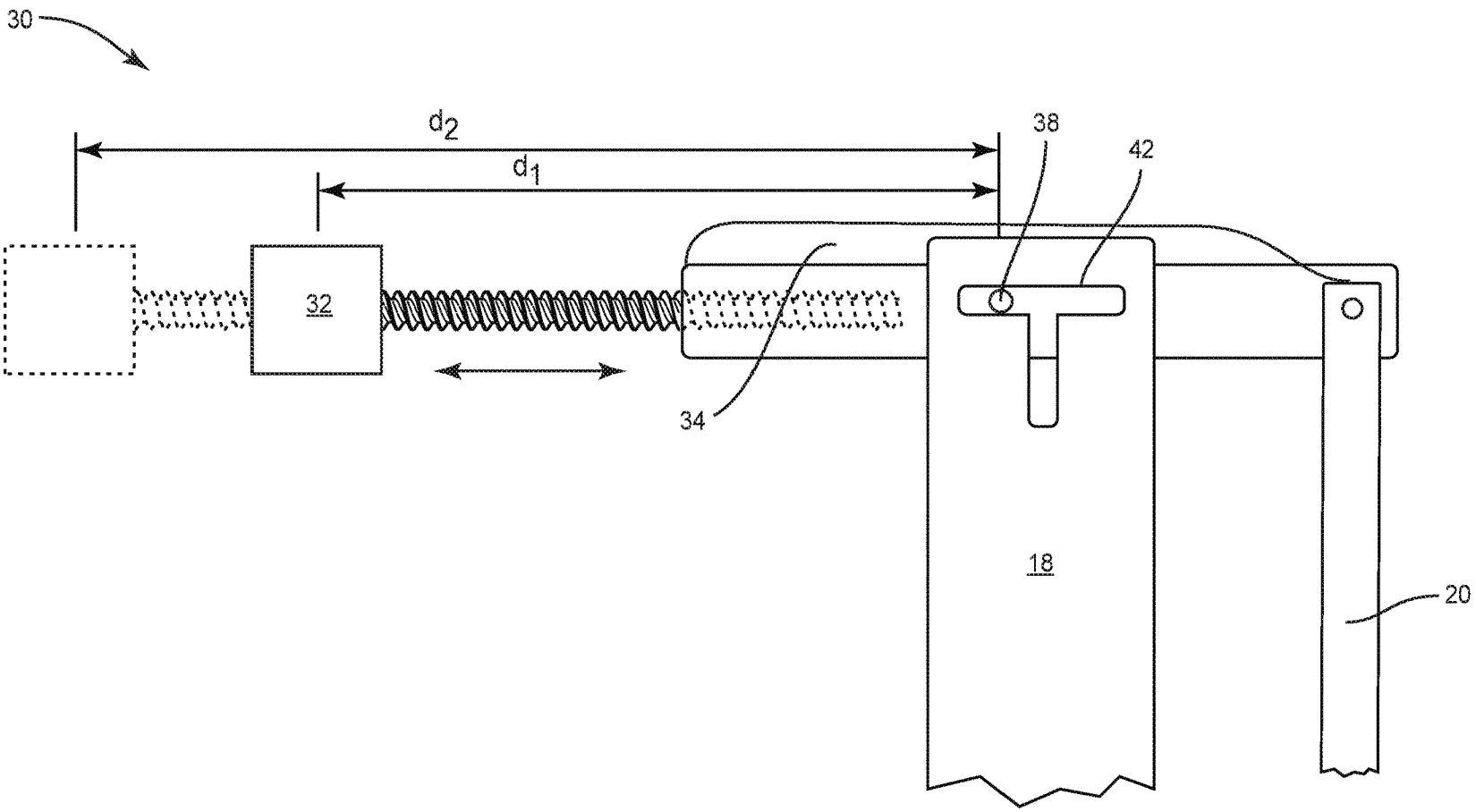
FIG. 5 illustrates an axially adjustable counterweight, and a T-slot for adjustably connecting an arm assembly to a lift assist chair according to one embodiment of the present disclosure.

FIG. 5 illustrates the counterweights 32 of the embodiment in FIGS. 4A-4B in more detail. As seen in FIG. 5, the counterweight 32 threadingly engages a threaded receptacle formed inside of arm 34. As previously stated, the user may rotate the counterweight 32 such that the counterweight 32 moves axially towards or away from the pivot point 38 and moment axis $a_m$. Moving the adjustable counterweight 32 towards or away from pivot point 38 and moment axis $a_m$ adjusts the distance d1, d2 between the counterweight 32 and the pivot point 38 (i.e., the moment axis $a_m$), which in turn, adjusts the moment of the arm assembly 30 as previously described.

Additionally, FIG. 5 also illustrates an embodiment of the present disclosure in which the stanchion 18 is formed to facilitate an adjustable connection between stanchion 18 and arm assembly 30. As seen in FIG. 5, stanchion 18 is formed to comprise a T-slot 42. The T-slot is configured to allow for the vertical and/or horizontal movement of the arm assembly 30 relative to stanchion 18, thereby allowing the user to move the arm assembly 30 into a position that is most comfortable for the user. Upon moving the arm assembly 30 into a desired position, the user can lock the arm assembly 30 against further movement using any known locking device.

Figure 6B:
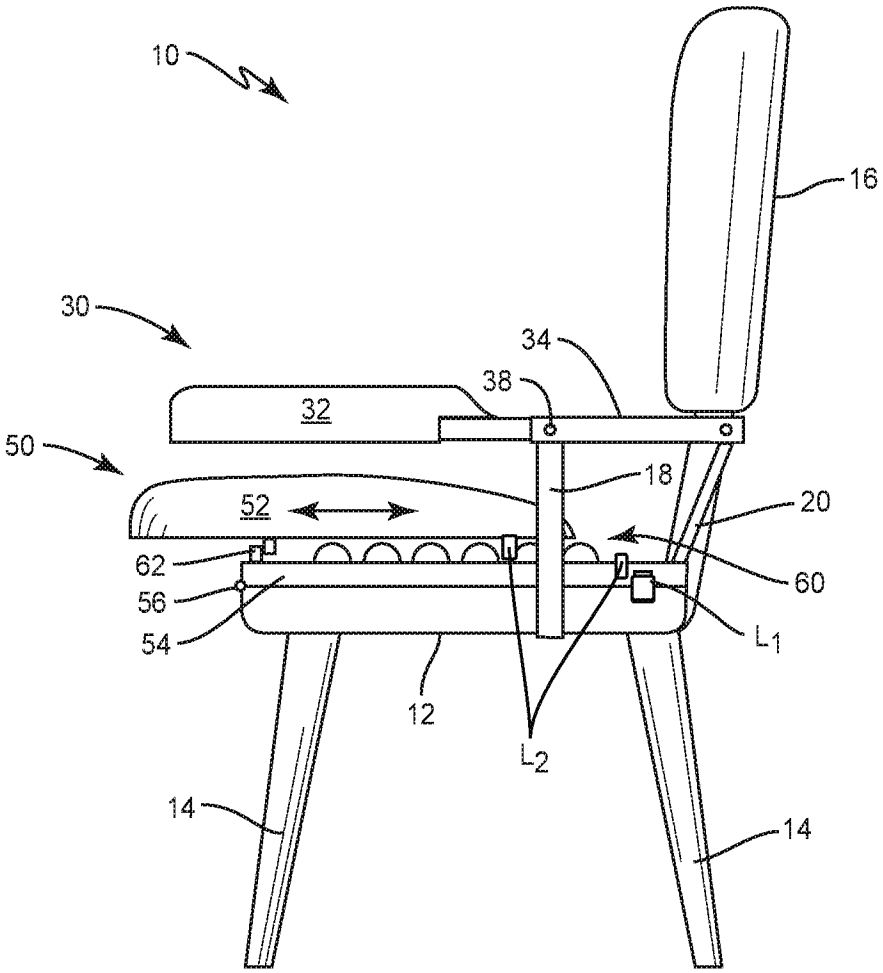
FIGS. 6A-6C illustrate a lift assist chair configured with a slidable seat assembly according to one embodiment of the present disclosure.
Figure 6A:
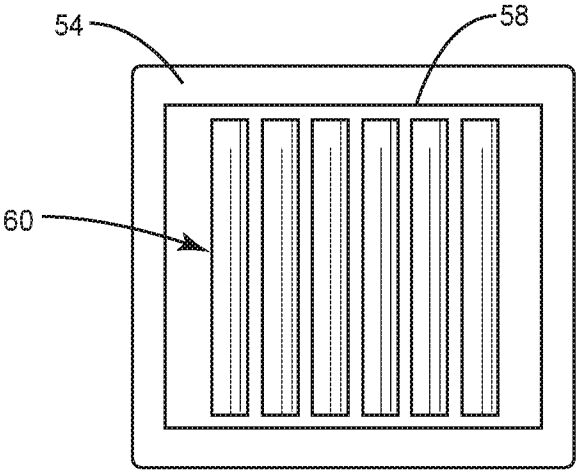
Figure 6C:
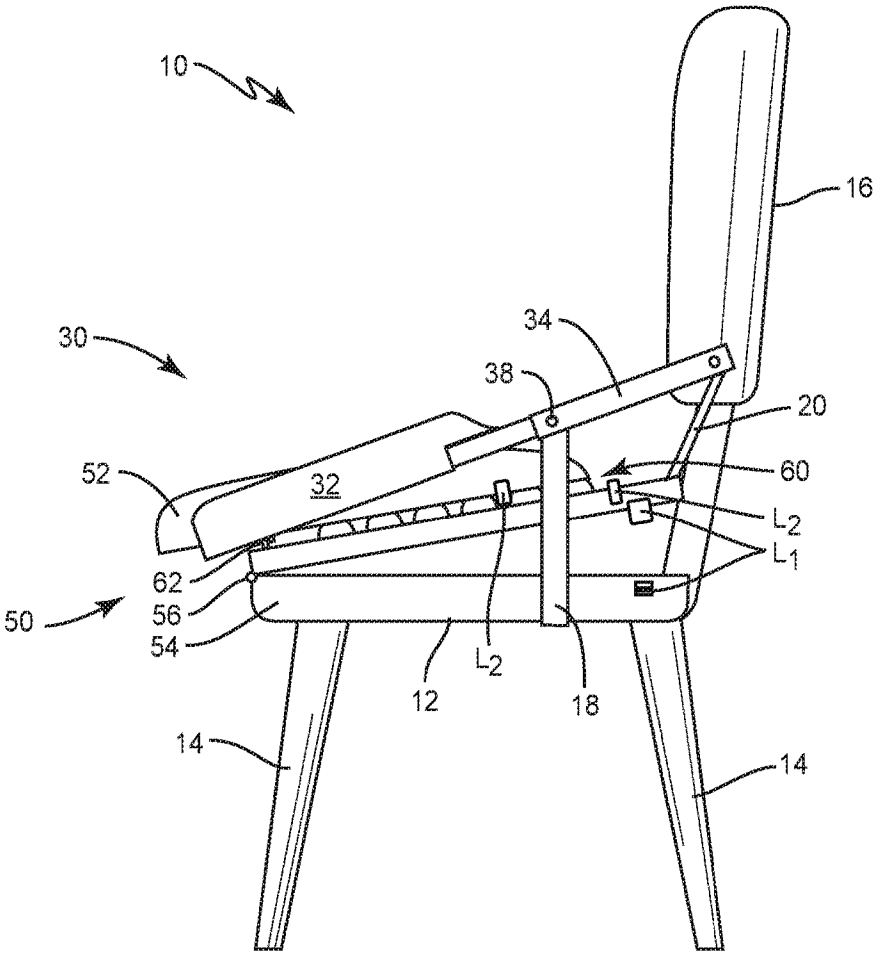

FIGS. 6A-6C illustrate another embodiment of the present disclosure in which seat cushion 52 of lift assist chair 10 moves relative to seat base 54. As seen in FIG. 6A, the seat base 54 is formed to include a recessed cavity 58 having a plurality of cylindrical rollers 60 disposed therein. Each roller 60 is configured to rotate individually of the other rollers 60. A surface of the underside of seat cushion 52 may be configured to frictionally engage the plurality of rollers 60. For example, in one embodiment, the underside of seat cushion 52 comprises a textured surface.

In use, a user sitting on seat cushion 52 is able to slide the seat cushion 52 forwards and backwards over the rollers 60 relative to the seat base 54. A latch $L_2$, which is also operated by the user, may be present in some embodiments to prevent any undesirable forward and backward motion of the seat cushion 52. Particularly, when latch $L_2$ is in a latched position, seat cushion 52 is prevented from moving across the plurality of rollers 60, while in the unlatched position, latch $L_2$ allows seat cushion 52 to move back and forth across the rollers 60. The textured surface of the seat cushion, as well as the weight of the user sitting on the seat cushion, helps to slide the seat cushion 52 over the rollers 60 when latch $L_2$ is in the unlatched position. This enables a user in a sitting position to slide forward into a position in which he or she can easily get out of the chair 10. Additionally, it enables a user in a standing position to sit on the seat cushion 52 and then easily slide the seat cushion 52 backwards into the chair 10.

For example, as seen in 6B and 6C, a user may push down on the adjustable counterweight 32 thereby pivoting the arm assembly 30 downward and lifting the seat assembly 50 through angle $\alpha$ and into the raised position. In this position, gravitational forces may pull a user still be sitting on the seat cushion 52 forward as the seat cushion 52 rolls over the plurality of cylindrical rollers 60. Stops 62 formed on a front portion of the seat base 54 and on the seat cushion 52 ceases the forward movement of the seat cushion 52 at a predetermined point, thereby preventing the seat cushion 52 from sliding off the chair 10 and onto the floor.

FIG. 6B illustrates the latch $L_2$ on a side of the chair 10. However, those of ordinary skill in the art will appreciate that this is illustrative only. The number and types of latches $L_2$ that are suitable for use in embodiments of the present disclosure, as well as the placement of such latches on chair 10, are not restricted.

Figure 7:
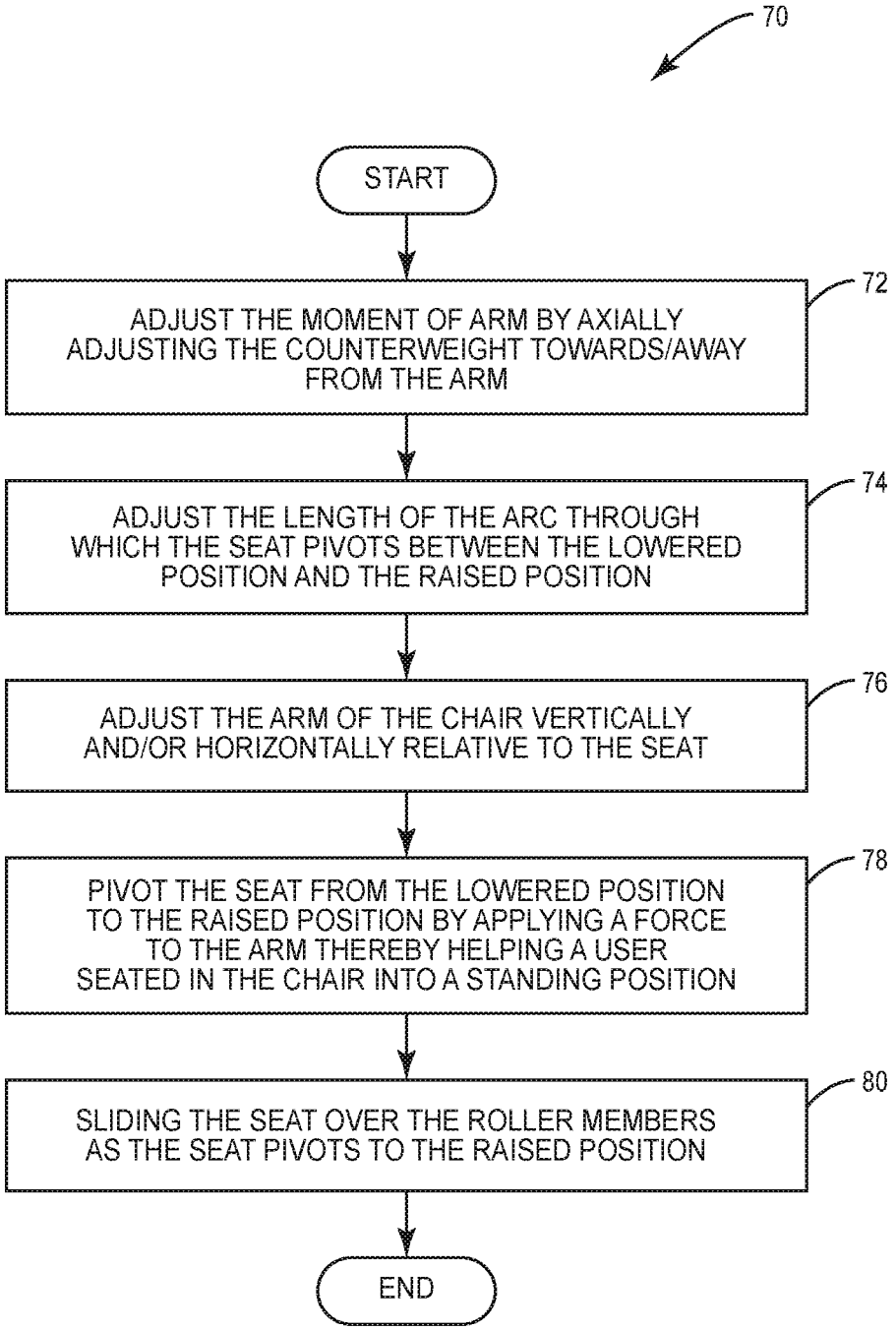
FIG. 7 is a flow diagram illustrating a method of assisting a user who is sitting in the lift assist chair into a standing position according to one embodiment of the present disclosure.

FIG. 7 is a flow diagram illustrating a method of assisting a user sitting in the chair 10 into a standing position. Method 70 begins with adjusting the moment of the arm 34 by axially adjusting the counterweights 32 attached to each arm 34 towards or away from a pivot point 38 associated with the corresponding "left" or "right" arm assembly 30 (box 72). Next, the user adjusts the angle $\alpha$ (i.e., the length of the arc) through which the seat assembly 50 pivots between the lowered position and the raised position. As previously stated, this may be accomplished by the user adjusting the point at which connector 20 connects to the arm 34 (box 74). For example, consider an embodiment where the connector 20 connects to the arm 34 proximate a terminal end of the arm 34 (see FIG. 3A). Moving this connection to a more forward position (see FIG. 3B) effectively alters a length of the connector 20, and thereby, alters the angle $\alpha$ through which the seat base 52 and seat assembly 50 pivots. Next, the user may adjust the arm assembly 30 vertically and or/horizontally along the T-slot 42 formed in stanchion 18 to ensure that the positioning of the arm assembly 30 is comfortable.

Once the user has performed the adjustments, the user pivots the seat assembly 50 from the lowered position to the raised positon by applying a downward force $F_{D1}$ (or $F_{D2}$) to a front portion of each counterweight 32. This causes seat assembly 50 to pivot on hinge 56 through angle $\alpha$ such that the rear of the seat assembly 50 rises up and away from frame 12 of chair 10 (box 78). Additionally, in embodiments where the seat assembly 50 comprises a plurality of rollers 60, as seen in FIGS. 6A-6C, the seat cushion 52 may move forward relative to the seat base 54 thereby placing the user into a better position to stand once the seat assembly 50 has been rotated through angle $\alpha$ (box 80). Regardless of whether chair 10 does or does not have the plurality of rollers 60, however, the adjustable counterweights 32 are axially movable by the user relative to the pivot points 38 associated with the arms 32 to increase and decrease the amount of downward force $F_{D1}$, $F_{D2}$ that the user must apply to pivot the arm assemblies 30 downward and raise the seat assembly 50 from the lowered position, in which a user seated in chair 10 is supported, to the raised position, in which the seated user is assisted into a standing position.

The previous embodiments are described in terms of pivoting the seat assembly 50 from the lowered position in which the user can sit in chair 10 to the raised position in which the seated user is assisted into a standing position. Further, the amount of force necessary to pivot the seat is user adjustable given the counterweights 32 that are connected, respectively, to the first and second arm assemblies 30. However, those of ordinary skill in the art will readily appreciate that the present embodiments are illustrative only, and that a chair 10 configured according to the present embodiments is also able to assist a user who wishes to transition from the standing position into a seated position.

More particularly, the user may select the adjustable counterweights 32 so as to maintain the seat assembly 50 in the raised position when the user is not sitting in chair 10. To lower the seat assembly 50 from the raised position to the lowered position, the user needs only to apply a downward force $F_{D1}$, $F_{D2}$ to the front portion of the arm assemblies 30 while sitting into the seat assembly 50. Sitting in the chair 10 will cause the seat assembly 50 to pivot downwardly through angle $\alpha$ back to return to the lowered position; however, both the downward force $F_{D1}$, $F_{D2}$ applied by the user, and the weight of the counterweights 32, will yieldingly resist the seat assembly 50 returning to the lowered position. In this manner, the user will slowly and deliberately be assisted into the seated position.

Additionally, a lift assist chair 10 configured according to one or more of the present embodiments is portable so as to facilitate a user (or other person) transporting the chair 10 from a first location to a destination location. By way of example, in one embodiment, the user may disassemble chair 10 into multiple parts and/or sub-assemblies. Once disassembled, the user may store the parts of chair 10 into a bag or other container for transport to a destination location. Once the user has arrived at the destination location, the user can simply reassemble the parts and/or subassemblies.

In another embodiment, all or part of the list assist chair 10 is foldable or collapsible to facilitate portability. Particularly, in some embodiments, lift assist chair 10 comprises one or more articulated portions that are configured to be folded or collapsed by the user. In such embodiments, users can fold or collapse the lift assist chair 10 from expanded state, in which the chair 10 is configured to support the weight of a seated user, to a folded or collapsed state for travel to a destination. Once the user has arrived at the destination and wishes to sit in the chair 10, the user need only to unfold or expand chair 10 from its folded or collapsed state to the expanded state. Of course, there are methods and structures for chair 10 other than what is described herein that facilitate portability to allow users to move chair 10 from place to place.

The lift assist chair 10 of the present embodiments provides benefits that conventional lift assist devices are not able to provide. For example, because the counterweights 32 provide equilibrium for the user, the lift assist chair 10 facilitates the user's ability to get into and out of chair 10 without requiring assistance from others. This beneficially reduces the stress and/or fatigue that is placed on the user due to various maladies such as muscular, skeletal, or joint disorders, for example, as the user transitions between a sitting position and a standing position.

Further, as seen in the figures, the arms of chair 10 are illustrated as being generally straight. However, this is for illustrative purposes only. Those of ordinary skill in the art will readily appreciate that the arms of chair 10 may be configured in any size and/or shape needed or desired. In one embodiment, for example, the pivotable arms of chair 10 are configured to have a generally "S" shape with a front part of the arms curving in a generally upward direction. The counterweights, as previously described, are movable attached to the front of the "S" shaped arms. The seat base 54 can be connected to a track formed along the rear portion of the "S" shaped arms. In use, the upward curved portion of the "S" shaped arms provides additional leverage for a seated user such that the user can easily push on the arms to raise the rear of the seat assembly 50 and raise a seated user from a sitting position into a standing position.

The present disclosure may, of course, be carried out in other ways than those specifically set forth herein without departing from essential characteristics of the invention. For example, as previously stated, the chair 10 shown in the figures is a chair that is likely to be associated with a desk or a table. However, the embodiments of the present disclosure, as those of ordinary skill in the art will appreciate, can also be utilized with other types of devices on which a user may be seated. Such devices include, but are not limited to, couches, stools, toilets, and the like. Therefore, the present embodiments are to be considered in all respects as illustrative and not restrictive, and all changes coming within the meaning and equivalency range of the appended claims are intended to be embraced therein.

What is claimed is:

1. A lift assist chair comprising:

a frame;

a seat pivotably connected to the frame and configured to pivot between a lowered position to support a user seated in the chair, and a raised position to assist the user into a standing position;

first and second arms pivotally connected to the seat on stanchions rigid with the seat, and configured to pivot the seat to the raised position by fulcrum action responsive to a force applied to the first and second arms by the user; and first and second adjustable counterweights connected, respectively, to the first and second arms, wherein each of the first and second counterweights is adjustable relative to the first and second arms between extended and retracted positions to change an amount of the force necessary to pivot the seat to the raised position.

2. The lift assist chair of claim 1 wherein the adjustment of the first and second counterweights changes a corresponding moment of the first and second arms, respectively.

3. The lift assist chair of claim 1 wherein each of the first and second arms pivot about a moment axis, and wherein each of the first and second counterweights is adjustable to increase or decrease a distance between the first and second counterweights and the moment axis.

4. The lift assist chair of claim 3 wherein the force that is required to be applied to the first and second arms by the user to pivot the seat to the raised position:

is decreased when the user moves the first and second counterweights away from the moment axis; and is increased when the user moves the first and second counterweights towards the moment axis.

5. The lift assist chair of claim 1 further comprising first and second adjustable connectors operatively connecting the first and second arms, respectively, to the seat, and wherein the first and second adjustable connectors are configured to alter an angle through which the seat pivots between the lowered position and the raised position.

6. The lift assist chair of claim 5 wherein a length of each of the first and second adjustable connectors is adjustable to alter the angle through which the seat pivots.

7. The lift assist chair of claim 1 wherein the seat comprises:

a base pivotably connecting the seat to the frame, and having a cavity;

a seat cushion; and one or more roller members disposed in the cavity, and configured to allow the seat cushion to slide over the base when the seat pivots between the lowered and raised positions.

8. The lift assist chair of claim 7 wherein an underside of the seat comprises a surface configured to frictionally engage the one or more roller members.

9. The lift assist chair of claim 7 further comprising one or more stops configured to limit a range over which the seat cushion slides over the base.

10. The lift assist chair of claim 1 wherein the stanchions comprise first and second stanchions disposed on opposite sides of the chair, and wherein the first and second arms are pivotably connected to the first and second stanchions, respectively.

11. The lift assist chair of claim 10 wherein each of the first and second stanchions is configured to allow the user to move the first and second arms in one or both of a horizontal direction and a vertical direction relative to the first and second stanchions.

* * * * *